US005929366A

United States Patent [19]

Kennedy

[11] Patent Number: 5,929,366

[45] Date of Patent: Jul. 27, 1999

[54] AMMUNITION FEED MECHANISM

[75] Inventor: Michael G Kennedy, Nottingham, United Kingdom

[73] Assignee: CTA International SAS, Bourges Cedex, France

[21] Appl. No.: 08/959,271

[22] Filed: Oct. 28, 1997

[30] Foreign Application Priority Data

Oct. 29, 1996 [GB] United Kingdom ..... 9622508

[51] Int. Cl.[6] ..... F41A 9/03

[52] U.S. Cl. ..... 89/33.17; 89/33.02; 193/25 AC

[58] Field of Search ..... 89/33.02, 33.1, 89/33.17, 34, 33.01; 193/25 AC

[56] References Cited

U.S. PATENT DOCUMENTS

| | | | |
|---|---|---|---|
| 1,693,460 | 11/1928 | Paulus et al. | 89/33.16 |
| 2,833,182 | 5/1958 | Houston et al. | 89/33.02 |
| 3,800,658 | 4/1974 | Houghland et al. | 89/33.02 |
| 4,448,299 | 5/1984 | Creusot-Loire | 89/33.1 |
| 4,676,137 | 6/1987 | Stockton et al. | 89/33.02 |
| 4,766,800 | 8/1988 | Miller et al. | 89/33.02 |
| 4,965,951 | 10/1990 | Miller et al. | 89/33.02 |

FOREIGN PATENT DOCUMENTS

| | | | |
|---|---|---|---|
| 315009 | 10/1919 | Germany | 89/33.02 |
| 315058 | 10/1919 | Germany | 89/33.02 |

*Primary Examiner*—Stephen M. Johnson
*Attorney, Agent, or Firm*—Nixon & Vanderhye P.C.

[57] ABSTRACT

A feed mechanism for use transferring linkless ammunition especially cased telescoped ammunition, from location to another, and simultaneously changing the orientation of its axis, comprising an Archimedes feed screw (11) and a cam track (14, 18, 17) located around the feed screw. Successive rounds (8) of ammunition are fed to the screw (11) so as to be received in the troughs of the screw thread. The cam track holds the rounds engaged within the troughs (15), while rotation of the screw advances the round along the cam track. The cam track is shaped so as to rotate the axis of successive rounds as they are advanced along its length to a discharge end.

10 Claims, 3 Drawing Sheets

AMMUNITION FEED MECHANISM

BACKGROUND OF THE INVENTION

1. Field of the Invention

This invention relates to a feed mechanism for use in transferring linkless ammunition from one location to another and simultaneously changing its orientation. The invention is especially but not exclusively applicable to the handling of cased telescoped ammunition.

2. Discussion of Prior Art

In use of a weapon system comprising a gun and ammunition, a feed system may be required for conveying ammunition from a storage area and delivering the ammunition to the gun, in an orientation such that it can be automatically loaded. Space is normally at a premium, and the available feed path may require that the ammunition is rotated about more than one axis while maintaining a driving force for transporting the ammunition, and controlling the feed path and the pitch spacing between successive rounds.

With conventional linked ammunition rotation of the axis of the ammunition can be achieved by pulling an articulating link, while guiding the ammunition through a feed guide. With linkless ammunition, the absence of a link necessitates a mechanism to apply a driving force and to control the pitch between rounds of ammunition.

Existing proposals to rotate linkless ammunition about more than one axis utilise a series of shafts and sprockets which are spaced in such a configuration as to induce a turning motion. The ammunition is driven through such a mechanism which provides both the driving force and the positional control. A series of iterations is required to rotate the axis of the ammunition in small steps, until tho desired change of orientation is achieved. Such a system requires a number of shafts and sprockets at compound angles to one another, is bulky, complex, costly, and difficult to manufacture.

SUMMARY OF THE INVENTION

The present invention seeks to provide an ammunition feed mechanism for changing the orientation of linkless ammunition, which is simple, reliable and compact.

According to the present invention there is provided an ammunition feed mechanism comprising a cam track for receiving and guiding a round of ammunition so as to move it along the track, and a helical feed screw rotatable about its own axis, for advancing successive rounds of ammunition along the cam track, wherein the form of the cam track is such as to rotate the axis of a round about the axis of the feed screw when the round is advanced along the cam track.

Preferably the cam track defines at least one cam surface along which a round of ammunition can be moved transversely with respect to its longitudinal axis.

Advantageously, the helical feed screw is adapted to receive successive rounds individually within its thread form, each with the axis of the round aligned along the thread trough, the cam track has a cam surface which is disposed around the feed screw and is adapted to receive and guide successive rounds of ammunition along its length, the cam track has an entry portion defining an entry portion of the cam surface which is adapted to receive successive rounds and present them successively to the feed screw in a first predetermined orientation in which they are also receivable in said thread form, the cam track has a discharge portion defining a discharge portion of the cam surface which is adapted to receive successive rounds and discharge them from the feed screw in a second predetermined orientation, said entry and discharge cam track portions are spaccd from one another axially along the feed screw, the cam track has an intermediate portion defining an intermediate portion of the cam surface which effects a smooth transition between the said entry and discharge portions, said cam surface is radially spaced from said feed screw by a distance such as to retain each successive round within said thread form, and said cam track further comprises hearing surfaces for limiting movement of a round along its own axis relative to the cam track.

Thus on rotation of the helical feed screw the appropriate sense, a round of ammunition which is received by the feed mechanism is transported axially along the length of the screw, while being constrained by the cam track within the thread form. At the same time, the cam track guides the round so that its axis is rotated from the first to the second predetermined orientation.

Preferably the thread form of the feed screw is pancircular in cross-section, the cross-section being equal to or less than semi-circular. This form would be suitable for receiving a cylindrical portion of a round of ammunition having a diameter somewhat less than that of the thread form.

The cam surface is preferably in the form of an irregular helix. Desirably the helix angle increases from zero at the entry portion of the cam surface, to a maximum value within the intermediate portion of the cam surface, and reduces again to zero at the discharge portion of the cam surface.

The bearing surfaces can advantageously be in the form of a pair of rails which stand upwardly with respect to the cam surface, and run along its length, the rails being spaced apart by a constant distance. This arrangement is suitable for handling rounds of ammunition, the length between the ends of the round being slightly less than the said constant distance. It is especially suitable for use with cased telescoped ammunition, but can also be used with other forms of ammunition provided that the geometry of the rails is adapted to the physical shape of the round.

BRIEF DESCRIPTION OF THE DRAWINGS

The invention will now be described by way of example only with reference to the accompanying drawings, of which

DETAILED DISCUSSION OF THE PREFERRED EMBODIMENTS

Figure 1:
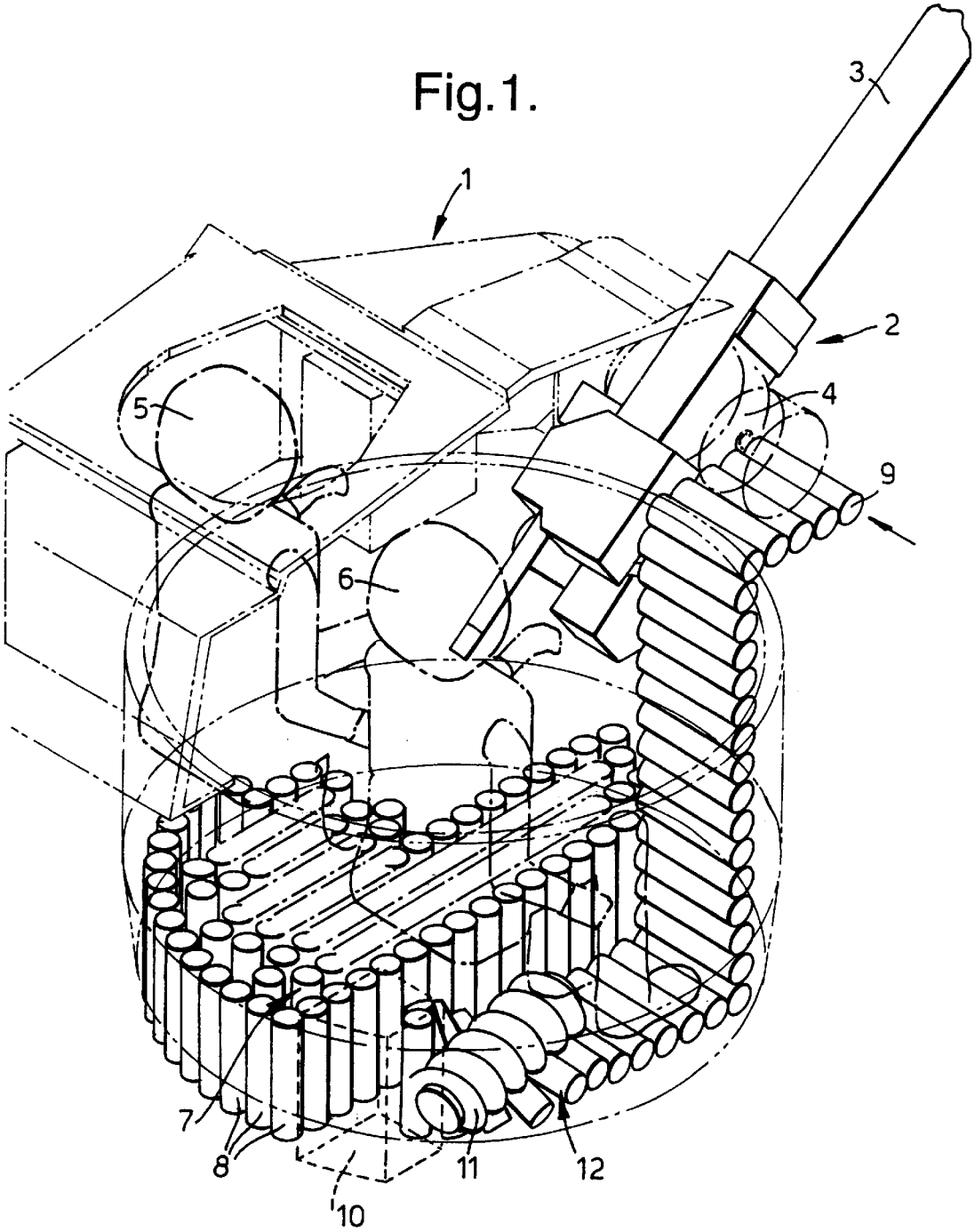
FIG. 1 shows diagrammatically, in perspective, the turret of a fighting vehicle equipped with an ammunition feed system according to the invention.

As shown in FIG. 1, the rotary turret 1 of a fighting vehicle is equipped with a cased telescoped weapon system comprising a gun 2 having a barrel 3 and a rotating chamber 4. Two crew members 5 and 6 are shown stated in the turret area, and there is limited space available for an ammunition storage area 7, in which about eighty rounds 8 of cased telescoped ammunition are stored in an upright position, standing on their ends.

In order to enter the rotating chamber 4, a round 8 needs to be transported from the storage area to the position of the round indicated at 9 adjacent the chamber, and its axis needs to be rotated from its vertical orientation as shown within the storage area 7, to the horizontal orientation shown at 9.

In order to achieve this, the ammunition is fed from the storage area 7 into a guide chute 10 from which it is presented to a helical screw 11 (shown diagrammatically in FIG. 1) forming part of the ammunition feed mechanism 12 according to the invention.

As described hereinafter, the feed mechanism 12 rotates the ammunition into the desired orientation, and delivers it to a conveyor system comprising guides (not shown) through which the ammnunition is transported without further rotation of its axis, to the location 9.

Figure 2:
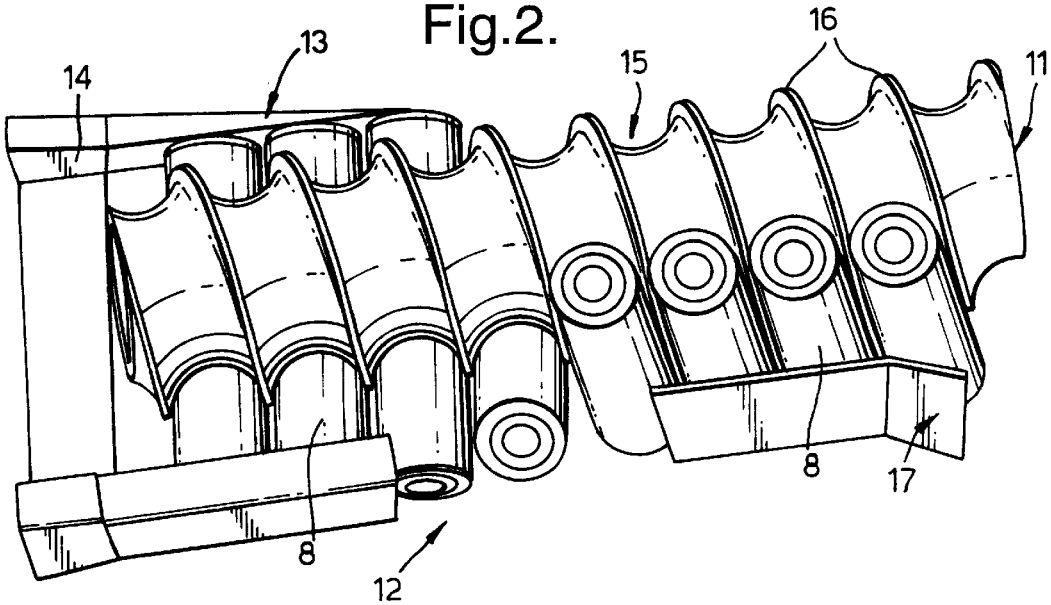
FIG. 2 is a perspective view showing the progress of rounds of cased telescoped ammunition through an ammunition feed system according to the invention, but with the intermediate cam portion omitted for clarity.
Figure 3:
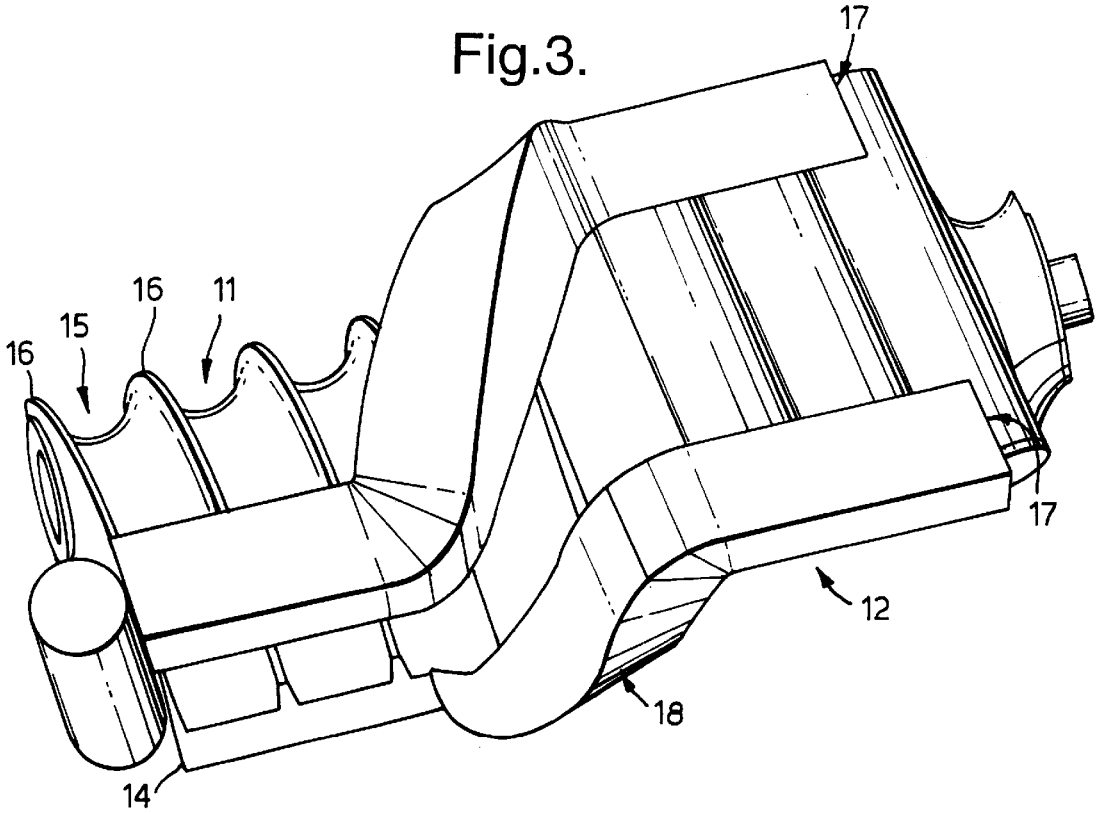
FIGS. 3 and 4 are perspective views from different viewpoints, showing the progress of rounds of cased telescoped ammunition through an ammunition feed system closely similar to the of FIG. 2.
Figure 4:
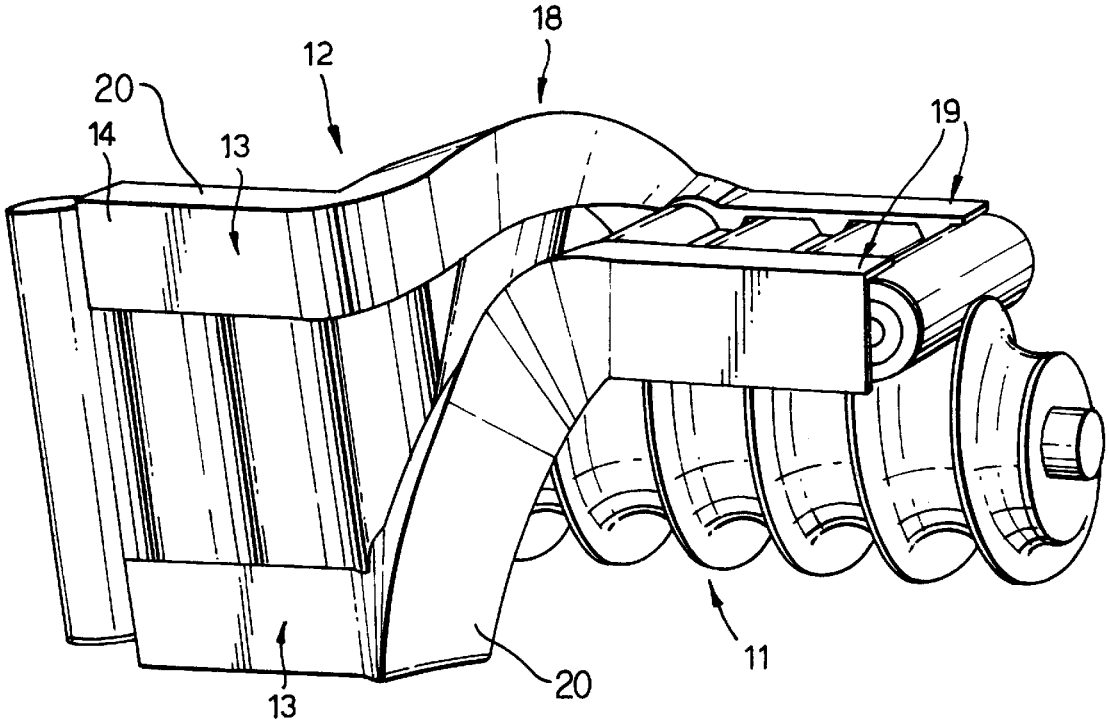

As shown in FIG. 2, the feed mechanism 12 comprises, in addition to the feed screw 11 cam track in for form of a guide member 14, 17, 18 defining a cam surface 19 which causes the ammunition axis to be rotated, while being transported along the screw through rotation thereof.

The guide member comprises an inlet section 14 defining a first cam portion of the surface 19 through which a round is prevented to the feed screw in a first orientation such that the longitudinal axis of the round lies along a trough 15 formed between adjacent thread flanks 16.

The thread form is part-circular in cross-section, somewhat less than semi-circular, and having a diameter somewhat greater than that of a round 8, so that the round is readily received within the trough of the thread.

The guide member further comprises a discharge section 17 defining a second cam portion of the surface 19 adapted to receive rounds when transported by rotation of the screw 11, and to discharge them in a second orientation corresponding to that required in order to enter the chamber 4 (as shown at 9, FIG. 1).

Between the inlet section 14 and the discharge section 17, the guide member has an intermediate portion 18 which defines an intermediate cam portion of the surface 19 (not shown in FIG. 2) which effects a smooth transition between the first and second cam portions. This intermediate portion of the cam surface 19 is in the form of a variable helix, whose angle varies progressively from zero at its interface with the inlet section 14 to a maximum within the intermediate portion 18, and again to zero at its interface with the discharge section 17.

The cam surface 19 of the guide member is spaced radially from the feed screw by a distance such as to retain the rounds 8 of ammunition within the trough of the screw thread, with adequate clearance so that rotation of the feed screw effects transport of successive rounds 8 along its length, and the guide member is provided with bearing surfaces along its length, in the form of upstanding guide rails 20 for limiting the movement of the rounds 8 along their own axis as they pass along the cam surface 19.

In use, successive rounds 8 are presented to the inlet section 14 through the chute 10, and become engaged by the threads of the feed screw 11 which is rotated about its axis. The spacing of successive rounds 8 is controlled by the thread pitch, as shown in FIG. 2, and the rounds are positively transported along the thread axis (and hence along the cam surface 19) by the rotation of the screw.

When each round enters the intermediate portion 18, it is obliged by the cam shape of this portion, to rotate its axis about that of the screw axis, as it moves along the screw axis. As shown in the figures, the rotation is through 90°, but any angle of rotation can be achieved by appropriate design. In this example, a 90° rotation is achieved within three pitches of the feed screw 11, but other rates of rotation are also possible.

Each round is then discharged, in its new orientation, via the discharge section 17.

An important characteristic of the invention is that the transport of ammunition through the feed device is reversible, ie ammunition can be fed from the storage area 7 to the gun 2, or by reversing the rotation of the feed screw, can be withdrawn away from the chamber 4 and returned to the storage area.

It will be readily apparent that the invention provides a feed mechanism which can rotate the ammunition under positive control through a predetermined angle, drives the rounds positively at all times, is reversible, is simple, relatively inexpensive, reliable and rugged, requires only one moving part, and most importantly is extremely compact.

I claim:

1. An ammunition feed mechanism for receiving entering rounds of ammunition and for discharging rounds of ammunition, said mechanism comprising a cam track for receiving said entering rounds, said entering rounds having parallel axes, and guiding said rounds of ammunition so as to move them along the track, and a helical feed screw rotatable about an axis of rotation, for advancing successive rounds of ammunition along a portion of the cam track, wherein the cam track is curved so as to rotate the axis of a round about the axis of the feed screw when the round is advanced along the cam track, said cam track discharging rounds of ammunition, said discharging rounds of ammunition having parallel axes.

2. An ammunition feed mechanism according to claim 1 wherein the cam track defines at least one cam surface along which a round of ammunition can be moved transversely with respect to its longitudinal axis.

3. An ammunition feed mechanism according to claim 2 wherein the helical feed screw is adapted to receive successive rounds individually within its thread form, each with the axis of the round aligned along a thread trough, the cam track has a surface which is disposed around the feed screw and is adapted to receive and guide successive rounds of ammunition along its length, the cam track has an entry portion defining an entry portion of the cam surface which is adapted to receive successive rounds and present them successively to the feed screw in a first predetermined orientation in which they are also receivable in said thread form, the cam track has a discharge portion defining a discharge portion of the cam surface which is adapted to receive successive rounds and discharge them from the feed screw in a second predetermined orientation, said entry and discharge cam track portions are spaced from one another axially along the feed screw, the cam track has an intermediate portion defining an intermediate portion of the cam surface which effects a smooth transition between the said entry and discharge portions, said cam surface is radially spaced from said feed screw by a distance such as to retain each successive round within its thread form, and said cam track further comprises bearing surfaces for limiting movement of a round along the axis of the round relative to the cam track.

4. An ammunition feed mechanism according to claim 3 wherein the thread form of the feed screw is part-circular in cross-section, the cross-sectional being equal to or less than semi-circular.

5. An ammunition feed mechanism according to claim 3 wherein the bearing, surface are in the form of a pair of rails which stand upwardly with respect to the cam surface, and run along its length, the rails being spaced apart by a constant distance.

6. An ammunition feed mechanism according to claim 1 which is adapted for use with cased telescoped ammunition.

7. An ammunition feed mechanism comprising a cam track for receiving and guiding a round of ammunition so as to move it along the track, and a helical feed screw rotatable about its own axis, for advancing successive rounds of ammunition along at least a portion of the cam track, wherein the cam track is curved so as to rotate the axis of a round about the axis of the feed screw when the round is advanced along the cam track, wherein the cam track is in the form of a helix having a variable helix angle.

8. An ammunition feed mechanism according to claim 7 wherein the helix angle increases from zero at an entry portion of the cam surface, to a maximum value within an intermediate portion of the cam surface, and reduces to zero at a discharge portion of the cam surface.

9. An ammunition feed mechanism assembly comprising at least one round of ammunition having an ammunition axis, a helical feed screw having a feed screw axis, said helical feed screw being rotatable about said feed screw axis, and said helical feed screw further having helical thread turns, of which adjacent thread turns define thread troughs therebetween, a cam track having a cam surface disposed at least partially around said feed screw axis and extending longitudinally thereof, said cam surface being radially spaced from said helical feed screw so as to define a space between said thread troughs and said cam surface, said at least one round being received in said space and located in a thread trough with the ammunition axis aligned along the thread trough, said cam surface having an entry portion which, when said at least one round is located within said entry portion space, holds said ammunition axis in a first predetermined orientation relative to the said feed screw axis, said cam surface having a discharge portion which, when said at least one round is located within said discharge portion space, holds the ammunition axis in a second predetermined orientation relative to the said feed screw axis, said entry portion and said discharge portion being spaced apart in the direction of the feed screw axis, said first and second predetermined orientations being different from each other in the sense of rotation of the ammunition axis about the feed screw axis, said cam surface also having an intermediate portion by which said entry portion and said discharge portion are connected, whereby, through rotation of the feed screw about the feed screw axis, said round of ammunition is transportable within said space and along the cam surface in the direction of the feed screw axis, and said ammunition axis is thereby rotated around the feed screw axis between said first and second predetermined orientations.

10. An ammunition feed mechanism assembly according to claim 9 wherein the round of ammunition is a cased telescoped round.

* * * * *